US005193467A

United States Patent [19]

Lichter

[11] Patent Number: 5,193,467

[45] Date of Patent: Mar. 16, 1993

[54] SAFE WITH MONEY SLOT

[76] Inventor: Robert J. Lichter, 15571 Placid Cir., Huntington Beach, Calif. 92647

[21] Appl. No.: 839,812

[22] Filed: Feb. 21, 1992

[51] Int. Cl.[5] ..... E06B 7/32

[52] U.S. Cl. ..... 109/66; 109/59 R; 109/69; 109/67

[58] Field of Search ..... 109/59 R, 59 T, 45, 109/55, 66, 67, 69, 77

[56] References Cited

U.S. PATENT DOCUMENTS

| | | | |
|---|---|---|---|
| 928,483 | 7/1909 | Wakeman | 109/59 |
| 1,969,412 | 8/1934 | Miller | 109/66 |
| 3,433,185 | 3/1969 | Roberts | 109/55 |
| 4,080,908 | 3/1978 | Bianco | 109/66 |
| 4,278,033 | 7/1981 | Sobel | 109/66 |
| 4,850,287 | 7/1989 | Lichter | 109/59 R |
| 4,852,503 | 8/1989 | Lichter | 109/59 R |

OTHER PUBLICATIONS

Conceal ·A· Safe advertisement entitled "Disappearing Money Drop Slot".

*Primary Examiner*—Renee S. Luebke
*Assistant Examiner*—D. Boucher
*Attorney, Agent, or Firm*—Richard L. Gausewitz

[57] ABSTRACT

A valuables safe incorporates a money slot that is both inaccessible and out of sight during periods when it is not desired to use the money slot, for example during off-hours in a business. The money slot is quickly made both accessible and visible by opening the safe and repositioning one element.

11 Claims, 2 Drawing Sheets

SAFE WITH MONEY SLOT

BACKGROUND OF THE INVENTION

It is often desired by the owners of businesses, etc., to insert money into a safe without going to the trouble of opening that safe. The problem, however, is that safes having money slots therein are relatively accessible by burglars. Furthermore, such safes typically will not be approved by underwriters.

SUMMARY OF THE INVENTION

It has now been discovered that an existing safe may be modified in a low-cost manner such as to provide a money slot therein. Then, the business person can easily insert money into the safe at various times during a working day. After the working day, the safe is opened and a simple procedure is followed whereby the money slot is rendered inaccessible and not visible to a burglar. The safe is then closed while the money slot is inaccessible and not visible.

The result is that a safe is provided which has the convenience of a money slot, but the safety of a safe not having a money slot. This result is achieved with an extremely small percentage increase in the manufacturing cost of the safe.

DETAILED DESCRIPTION OF THE PREFERRED EMBODIMENT

The present invention may be incorporated in different types of safes, for example sliding-door safes and hinged-door safes, and any liftout-door safes. In the safe shown in the present application, the door is of the sliding type.

Reference is made to my prior U.S. Pat. No. 4,850,287 for Safe with Double Sliding Door, and U. S. Pat. No. 4,712,490, for Safe Said patents are hereby incorporated by reference herein.

The invention may be incorporated in safes in which the main bodies of two doors, one such door being either hinged or sliding, are in the same plane when the safe is in closed condition. In the present preferred embodiment, however, the main bodies of the two doors are in different planes when the safe is in closed condition.

Figure 1:
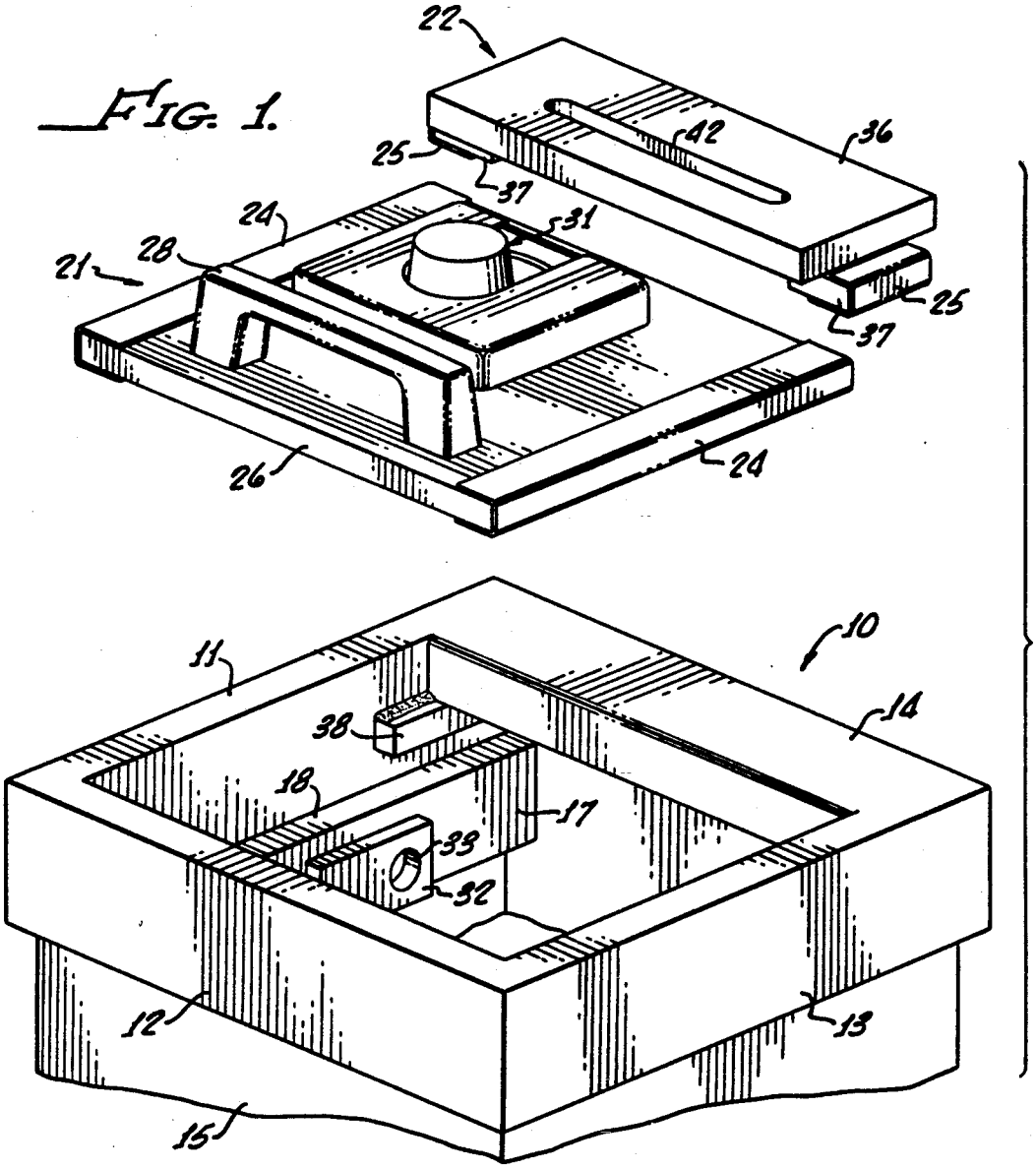
FIG. 1 is an exploded isometric view of a safe constructed in accordance with the present invention, in position to be closed with a money slot accessible to a business person.
Figure 2:
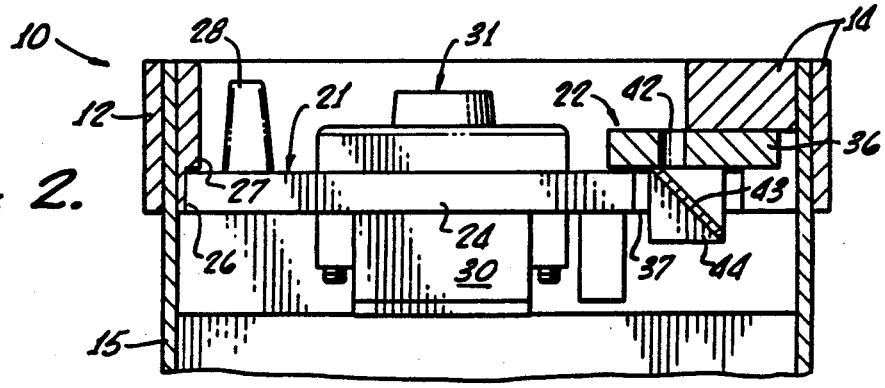
FIG. 2 is a vertical sectional view showing the parts of FIG. 1 assembled into a closed and locked safe, with the money slot exposed for use by the business person.

Referring to FIGS. 1 and 2, the upper end portion of a safe body is indicated at 10. This is a strong rectangular or square frame having four strong sides 11,12,13 and 14, from which extend downwardly the sidewalls 15 of the safe.

Provided in parallel relationship within the access . opening of the safe, just below opposed frame sides 11 and 13, are strong support bars 17.- These are strongly welded or otherwise secured to the sidewalls 15, being mirror images of each other about a vertical central plane that is parallel to frame sides 11 and 13. Support bars 17 have upper horizontal supporting surfaces 18 for sliding support of first and second safe-door portions 21 and 22, respectively. The regions of such door portions that ride on supporting surfaces 18 are preferably provided with friction-reducing synthetic resin channels 24 and 25.

Stated more specifically, the first door portion 21 is a large and strong steel door plate having an edge 26 that, when the safe is closed, is maintained beneath an overhanging ledge 27 (FIG. 2). Ledge 27 is formed on a bar that is fixedly provided on a sidewall 15. To open and remove the door portion 21, it is slid to the right as viewed in FIG. 2 until edge 26 is no longer beneath ledge 27, following which a handle 28 is lifted to remove such door portion from the access opening.

A lock mechanism 30 (FIG. 2) is mounted beneath door portion 21, and a dial means 31 is mounted above such door portion, so as to selectively prevent sliding of the door portion 21 and thus maintain it in closed condition. The lock 30 has a bolt adapted to extend until it is adjacent the left end (FIG. 1) of a rigidly-mounted bar 32, the result being that when the bolt is in extended condition the door portion 21 may not be shifted to the right from beneath the ledge 27. When, however, the lock is operated to retract the bolt, such sliding may occur. The illustrated bar 32 has a bore 33 therein which forms part of a relocking mechanism preferably associated with the locking mechanism. Reference is made to my co-pending patent application Ser. No. 839,834, filed on even date herewith, for a Burglar-Resistant Lock-Operating Construction for Safes. Said application, which describes elements 30,31 and the relockers, is hereby incorporated by reference herein.

Proceeding next to the description of the second door portion 22, this also comprises a strong steel plate, numbered 36. Plate 36 has slide and hold-down plates 37 welded to the undersides of opposite portions thereof. As shown at the upper right in FIG. 1, the plates 37 extend outwardly from edges of plate 36 and (as previously stated) have synthetic resin channels 25 thereon for a minimization of friction.

As shown in FIG. 2, the left and right ends of each plate 37 are spaced or indented inwardly from the ends (left and right edges as shown in FIG. 2) of plate 36. The amount of this indenting is sufficient that, regardless of which way the second door portion 22 is turned, the right edge (FIG. 2) of the first door portion 21 may slide beneath an edge of the plate 36. Regardless of what edge of steel plate 36 the first door portion 21 slides beneath, that edge cooperates with ledge 27 to prevent opening of the entire door means until the lock mechanism 30,31 is operated and the bolt retracted.

Horizontal bars 38 are welded to frame sides 11 and 13 immediately beneath frame side 14, projecting outwardly therefrom as shown in FIG. 1. These bars 38 act as hold-down bars, and also fill in the gaps between opposed portions of plate 36 and the vertical inner surfaces of frame sides 11 and 13. It is emphasized that there are two such bars 38, one on the inner surface of each frame side 11 or 13, the bars being mirror images of each other about the above-specified plane. The plates 37 are likewise mirror images of each other about such plane.

A money-insertion opening, which is preferably a slot 42 that extends perpendicularly to the direction of sliding of door portions 21,22, is provided in plate 36 as shown in all figures. An anti-fishing sheet 43 is welded beneath slot 42 as shown at the right in FIG. 2, the lower edge of such sheet 43 being provided with large angular teeth. The ends of sheet 43 are welded to ears 44 that extend downwardly from plate 36. Sheet 43 substantially prevents persons from fishing anything out of the slot 42 even when the safe is in the money-insertion condition of FIGS. 1-3, inclusive.

Figure 3:
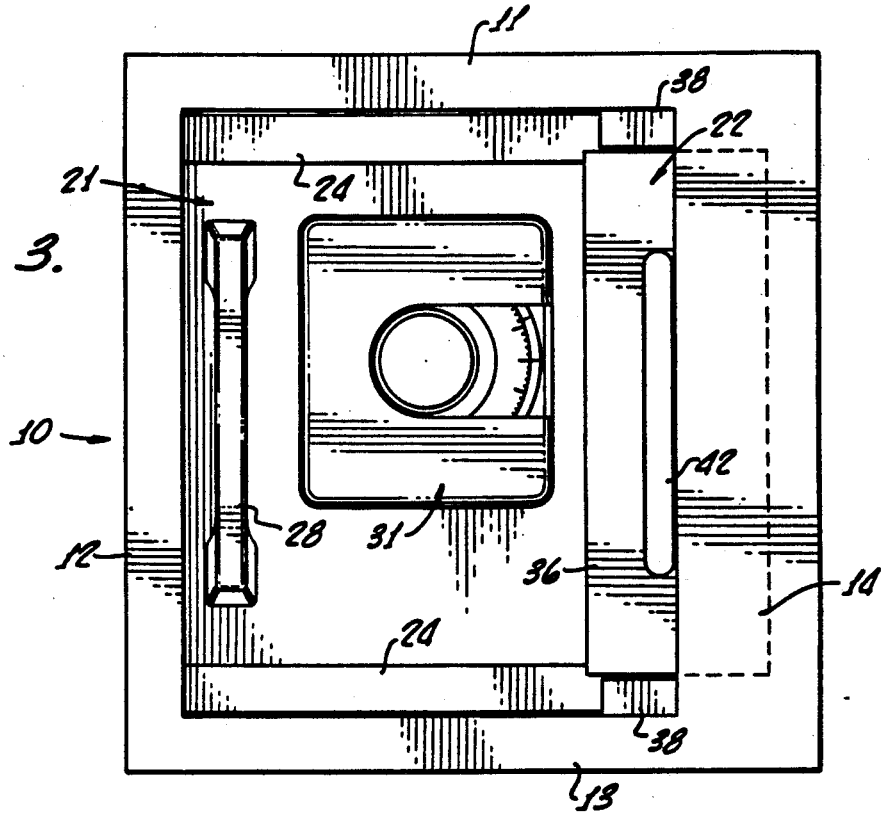
FIG. 3 is a top plan view of the showing of FIG. 2.

The slot 42 (or other money-insertion opening) is disposed in such position on plate 36 that it will be accessible to the user for insertion of money therethrough when the second door portion 22 (including plate 36) is in the position of FIGS. 1-3, inclusive. The slot position is also such that 180-degree rotation of the door portion 22 about a vertical axis will cause slot 42 to be beneath frame side 14 when the safe is closed, reference being made to FIG. 4. Thus, when the parts are in the FIG. 4 positions, the slot 42 is not only inaccessible but is concealed so that the burglar does not even know it is there.

The frame side 14 is wide in comparison to the other frame sides, so as to overhang in close-fitting relationship a major portion of the plate 36.

Figure 4:
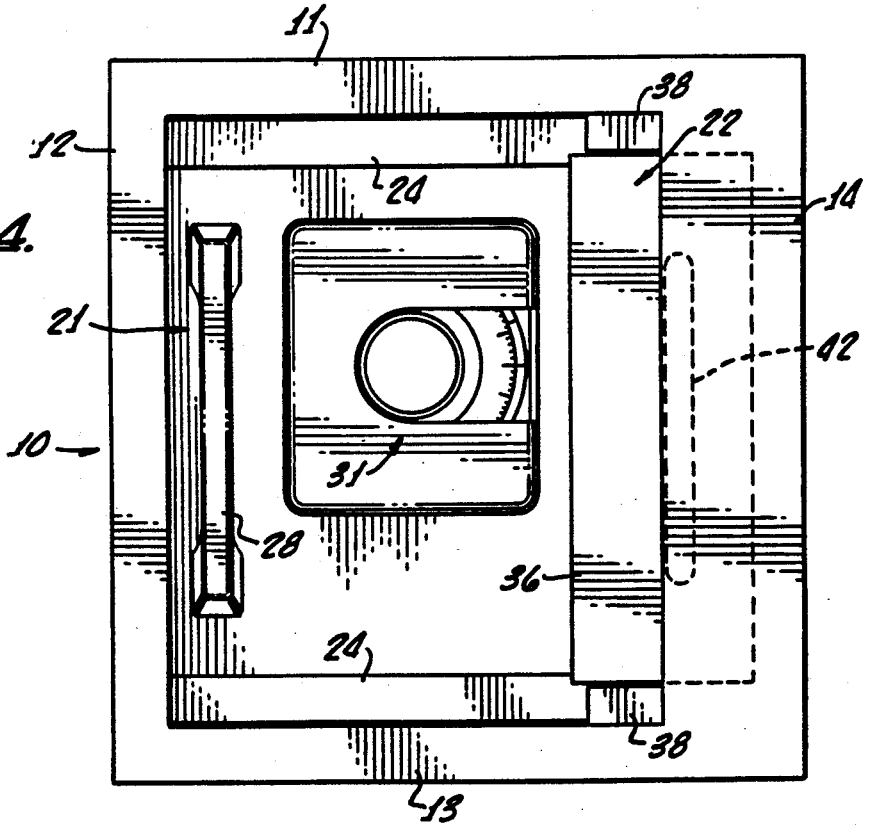
FIG. 4 is a top plan view corresponding to FIG. 3 but showing the parts assembled for concealing of the money slot and preventing access by a burglar to the same.

In the preferred embodiment, money slot 42 is on one side of the center line of plate 36, thus achieving the relationship illustrated in FIGS. 3 and 4, the money slot either being exposed, or hidden and inaccessible, depending upon which way the second door portion 22 is oriented.

DESCRIPTION OF THE METHOD

When the owner of (for example) a small business wishes to have the money slot 42 in exposed and usable condition, he or she orients the door elements 21,22 in the positions of FIGS. 1-3, inclusive. Firstly, the second door portion 22 is slid to the right along upper support surfaces 18 until it is inserted far beneath the overhanging frame side 14. At this time, the outer edges of plates 37 are beneath bars 38. Then, such owner grasps the handle 28 and inserts the right edge (FIGS. 1 and 2) of first door portion 21 beneath the left edge of second door portion 22. At the same time, the door portion 21 is pivoted downwardly until it rests on surfaces 18.

As the next step, first door portion 21 is slid to the left until edge 26 thereof is beneath ledge 27 (FIG. 2). Thereafter, the lock means 30,31 is operated to cause the lockbolt to extend, thus preventing door portion 21 from shifting to the right.

The second door portion 22 can then shift somewhat toward and away from first door portion 21, but not sufficiently far that the second door portion 22 gets out from beneath overhanging frame side 14, and not sufficiently far that the first door portion 21 does not have its right edge (FIG. 2) beneath the outer edge (left in FIG. 2) of second door portion 22. The bars 38 cooperate in the locking action, because they hold down plates 37 which in turn hold down plate 36.

Thus, in accordance with the principles stated in the issued patents cited at the first part of this specification, both doors are effectively maintained closed. Nevertheless, the money slot 42 remains accessible to the user.

When business is done for the day, and it is time to cover the money slot 42 and prevent any access thereto, the business person opens the safe by operating lock means 30,31 to retract the lockbolt, then sliding door portion 21 to the right, then lifting on handle 28 to remove door portion 21, and then sliding second door portion 22 to the left and removing it. The operator then turns the second door portion 22 180-degrees about a vertical axis and repeats the locking procedure described above. This achieves the no-slot-access, and no-slot-visibility, condition shown in FIG. 4.

The foregoing detailed description is to be clearly understood as given by way of illustration and example only, the spirit and scope of this invention being limited solely by the appended claims.

What is claimed is:

1. A valuables safe having a money-drop opening therein, said safe comprising:

(a) strong walls defining a valuables chamber,
said walls having an access-opening therein affording access to said valuables chamber, (b) a strong door to cover and block said access-opening,
said door being movable to an open condition permitting access to said valuables chamber for introduction of valuables therein or for removal of valuables or money therefrom, (c) lock means to lock said door in closed condition covering and blocking said access-opening,
said lock means preventing substantial movement of said door, (d) a strong money-drop element mounted at said access-opening in association with said strong door,
said money-drop element having a money-drop opening therein through which money may be inserted into said valuables chamber,
said money-drop element being adapted to be mounted in either a first orientation at said access-opening or a second orientation at said access-opening,
said money-drop element being so associated with said door that when said lock means is in locking condition said door holds said money-drop element in whichever of said first orientation or said second orientation said money-drop element is in, and (e) means positioned to overlie and block said money-drop opening when said money-drop element is in said first orientation, and to not overlie and accordingly permit access to said money-drop opening when said money-drop element is in said second orientation.

2. The invention as claimed in claim 1, in which said money-drop element second orientation is about 180 degrees different, than said money-drop element first orientation.

3. The invention as claimed in claim 1, in which said door and said money-drop element are each substantially planar, and lie in planes parallel to each other.

4. The invention as claimed in claim 1, in which said money-drop element is adjacent said door and is held in said first orientation or said second orientation by being engaged by said door while said door is closed and is locked by said lock means.

5. The invention as claimed in claim 4, in which said money-drop element second orientation it is about 180 degrees at a different, than said money-drop element first orientation.

6. The invention as claimed in claim 4, in which said door and said money-drop element are each substantially planar, and lie in planes parallel to each other.

7. The invention as claimed in claim 4, in which said money-drop element second orientation is about 180 degrees different, than said money-drop element first orientation, and in which said door and said money-drop element are each substantially planar, and lie in planes parallel to each other.

8. A valuables safe having a money-drop opening therein, said safe comprising:

(a) strong walls to define a valuables chamber,
said walls having an access-opening therein through which valuables may be introduced into and withdrawn from said valuables chamber, (b) a strong safe door mounted over a large portion of said access-opening and movable between a closed position blocking said large portion of said access-opening and an open position whereby said large portion of said access-opening is not blocked, (c) lock means to hold said door in said closed position, (d) support means provided on said walls adjacent said door, when said door is in said closed position, to support a money-drop element, (e) a strong money-drop element adapted to be supported on said support means adjacent said door, and when thus supported to block another portion of said access-opening to said valuables chamber,
said money-drop element having a money-drop opening therein,
said money-drop element being adapted to be manually rotated 180 degrees whereby said money-drop element has two orientations,
one of said orientations being such that one region of said money-drop element is adjacent said door,
the other of said orientations being such that another region of said money-drop element is adjacent said door, (f) a strong element mounted on said walls and closely overlying said money-drop element when said money-drop element is in position on said support means, adjacent said door, (g) said money opening provided in said money-drop element and so oriented that when said money-opening element is in said one orientation said money-drop is visible and accessible for introduction of money therethrough into said valuables chamber, and when said money-drop element is in said other orientation said money opening is beneath and covered by said strong element and accordingly is not exposed to view and is not accessible for receipt or withdrawal of money therethrough.

9. The invention as claimed in claim 8, in which said money-drop element is a plate that lies in generally a plane parallel to that of said door when said door and said money-drop element are in locking conditions.

10. The invention as claimed in claim 9, in which said money opening is an elongate slot which is positioned off-center relative to said money-drop plate, the amount of off-center positioning being such that said slot is exposed when said money-drop element is in said one orientation, and is blocked when said money-drop element is in said other orientation.

11. The invention as claimed in claim 8, in which said door is of the sliding-door type, and in which said lock means is mounted on said door, said lock means when in locking condition preventing sliding of said door.

* * * * *